US011519406B2

(12) United States Patent
Isoda et al.

(10) Patent No.: US 11,519,406 B2
(45) Date of Patent: Dec. 6, 2022

(54) OIL PUMP HAVING HOUSING WITH SEAL PORTION

(71) Applicant: AISIN CORPORATION, Kariya (JP)

(72) Inventors: Atsuo Isoda, Kariya (JP); Kenta Ide, Kariya (JP); Masato Kishi, Kariya (JP); Kazuya Horikawa, Kariya (JP); Tokiyuki Tanaka, Kariya (JP)

(73) Assignee: AISIN CORPORATION, Aichi (JP)

( * ) Notice: Subject to any disclaimer, the term of this patent is extended or adjusted under 35 U.S.C. 154(b) by 7 days.

(21) Appl. No.: 17/104,090

(22) Filed: Nov. 25, 2020

(65) Prior Publication Data

US 2021/0164469 A1 Jun. 3, 2021

(30) Foreign Application Priority Data

Nov. 29, 2019 (JP) ..... JP2019-217405

(51) Int. Cl.

| | |
|---|---|
| ***F04C 2/14*** | (2006.01) |
| ***F04C 13/00*** | (2006.01) |
| ***F04C 14/18*** | (2006.01) |
| ***F04C 15/00*** | (2006.01) |
| ***F04C 2/22*** | (2006.01) |

(52) U.S. Cl.

CPC ..... *F04C 2/22* (2013.01); *F04C 13/002* (2013.01); *F04C 15/0023* (2013.01); *F04C 2210/206* (2013.01); *F04C 2240/30* (2013.01); *F04C 2240/60* (2013.01)

(58) Field of Classification Search

CPC .. F04C 2/22; F04C 2/14; F04C 13/002; F04C 13/00; F04C 14/18; F04C 15/0023; F04C 15/0065; F04C 15/0076

See application file for complete search history.

(56) References Cited

U.S. PATENT DOCUMENTS

| | | | | |
|---|---|---|---|---|
| 2,408,716 | A * | 10/1946 | Witchger | F04C 2/102 417/372 |
| 5,085,187 | A * | 2/1992 | Black | F01M 1/02 123/196 R |
| 2005/0106053 | A1* | 5/2005 | Ohnishi | F04C 15/0049 418/61.2 |
| 2013/0022485 | A1* | 1/2013 | Hunter | F04C 25/02 418/3 |
| 2013/0052058 | A1* | 2/2013 | Motohashi | F01C 21/02 417/410.4 |
| 2014/0154120 | A1* | 6/2014 | Izutsu | F04C 2/10 418/19 |

FOREIGN PATENT DOCUMENTS

JP 2017020390 A 1/2017

* cited by examiner

*Primary Examiner* — Deming Wan

(74) *Attorney, Agent, or Firm* — Buchanan Ingersoll & Rooney PC

(57) ABSTRACT

A pump housing of an oil pump includes a suction port that supplies oil to a pump room, a discharge port that discharges oil from the pump room, and a seal portion that suppresses leakage of oil from the pump room to outside of the pump room. A shaft of the oil pump includes a small diameter portion and a large diameter portion having different diameters, the small diameter portion is connected to the inner rotor, and the shaft and the inner rotor integrally rotate. The seal portion is in contact with a side surface of the inner rotor extending in a diameter direction of the shaft, and also extends to a region in the diameter direction on an inner side smaller than the large diameter portion in the diameter direction.

4 Claims, 2 Drawing Sheets

OIL PUMP HAVING HOUSING WITH SEAL PORTION

CROSS REFERENCE TO RELATED APPLICATIONS

This application is based on and claims priority under 35 U.S.C. § 119 to Japanese Patent Application 2019-217405, filed on Nov. 29, 2019, the entire content of which is incorporated herein by reference.

TECHNICAL FIELD

This disclosure generally relates to an oil pump.

BACKGROUND DISCUSSION

In the prior art, an oil pump including a rotor is known. JP2017-20390A (Reference 1) discloses an oil pump including an inner rotor, an outer rotor, a pump housing, and a shaft. The inner rotor includes a plurality of external teeth. The outer rotor includes a plurality of internal teeth that engage with the external teeth of the inner rotor. The pump housing houses the inner rotor and the outer rotor. The shaft is inserted through the inner rotor and the pump housing, and is rotatably supported by the pump housing in such a way as to rotate together with the inner rotor. A pump room 34 (gap) is formed between the external tooth and the internal tooth, and pump action is performed by expanding and reducing the pump room.

As a method of reducing a size of an oil pump, it is conceivable to reduce a diameter of a shaft. On the other hand, when a diameter of a shaft is reduced, seizure occurs on a sliding surface between the shaft and a pump housing. In JP2017-20390A, the problem described above is solved by changing a size of a diameter of the shaft in a contact portion between the pump housing and the inner rotor.

However, in the oil pump in JP2017-20390A, a diameter of a part of the shaft is increased in order to suppress seizure, and thus a seal area of the pump housing and the inner rotor is accordingly reduced, and oil leaks. There is room for improvement in a decrease in discharge amount of oil.

A need thus exists for an oil pump which is not susceptible to the drawback mentioned above.

SUMMARY

An oil pump that solves the problem described above includes a pump housing including a rotor housing space inside, an inner rotor and an outer rotor being housed in the rotor housing space, a pump room being formed by the inner rotor and the outer rotor in the pump housing, and a shaft being inserted through the inner rotor. The pump housing includes a suction port that supplies oil to the pump room, a discharge port that discharges oil from the pump room, and a seal portion that suppresses leakage of oil from the pump room to the outside of the pump room. The shaft includes a small diameter portion and a large diameter portion having different diameters, and the small diameter portion is connected to the inner rotor, and the shaft and the inner rotor integrally rotate. The seal portion is in contact with a side surface of the inner rotor extending in a diameter direction of the shaft, and also extends to a region in the diameter direction on an inner side smaller than the large diameter portion in the diameter direction.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

First Embodiment

Figure 1:
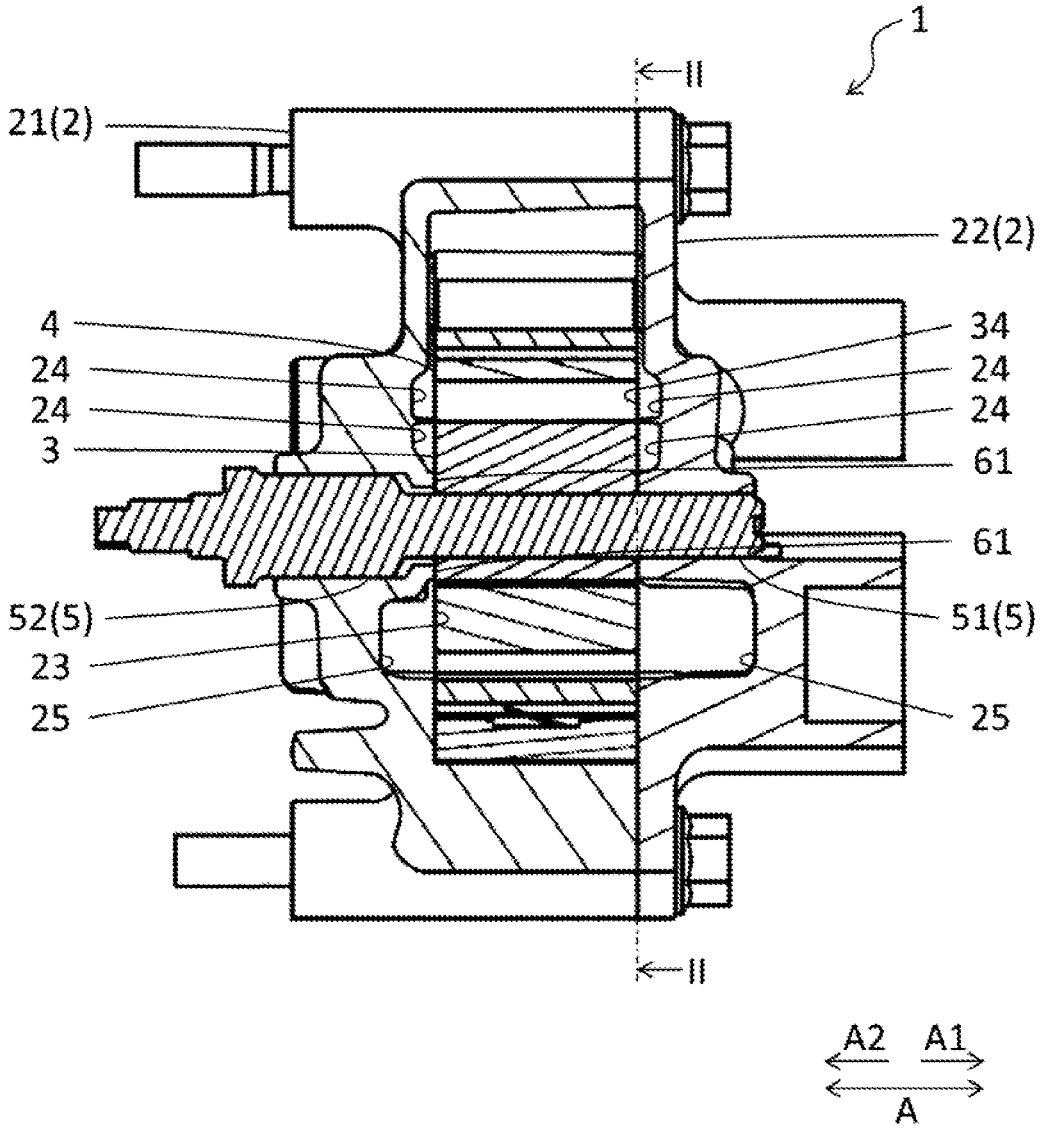
FIG. 1 is a cross-sectional view illustrating one example of a configuration of an oil pump 1 according to a first embodiment.
Figure 2:
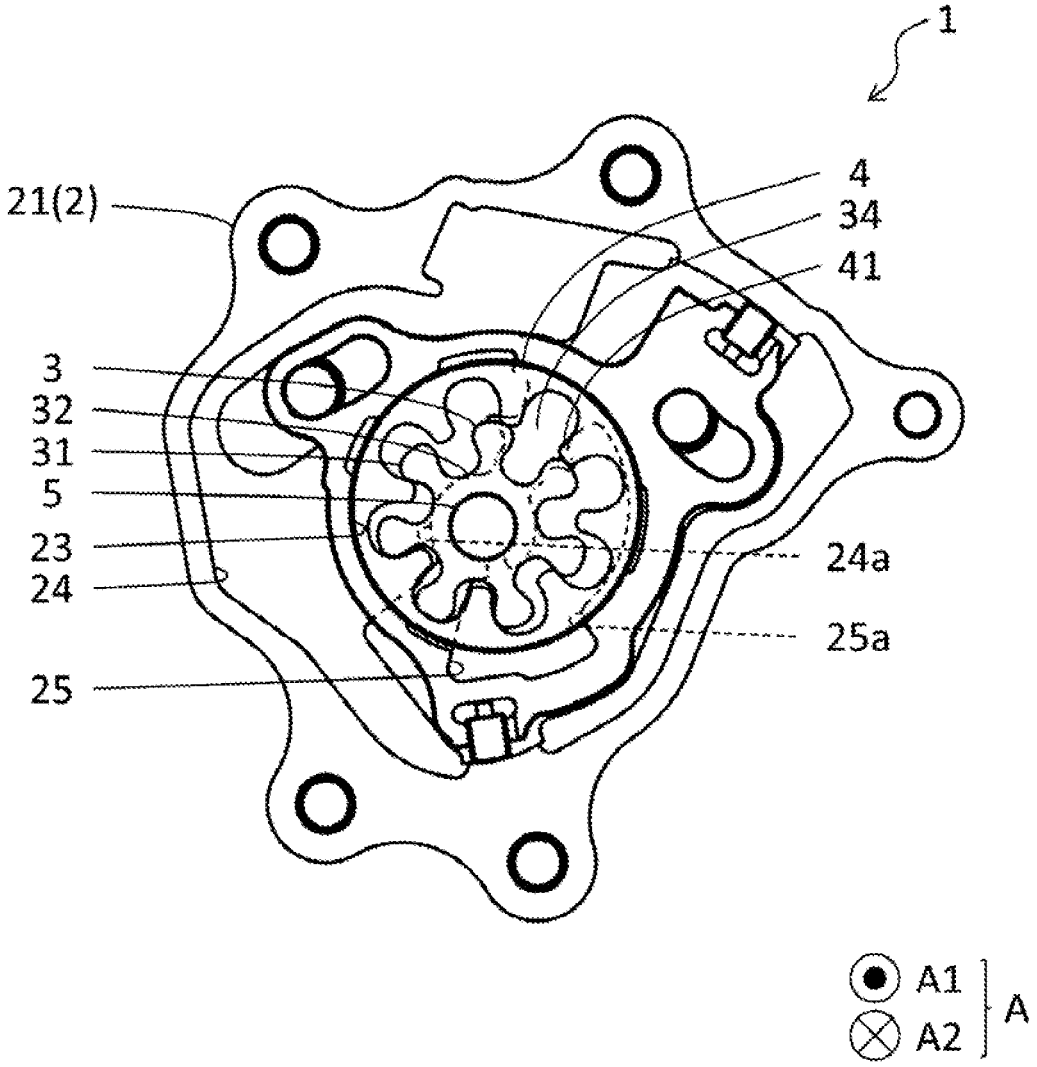
FIG. 2 is a cross-sectional view of the oil pump 1 according to the first embodiment taken along an II-II line in FIG. 1.

FIG. 1 is a cross-sectional view illustrating one example of a configuration of an oil pump 1 according to a first embodiment. FIG. 2 is a cross-sectional view of the oil pump 1 according to the first embodiment taken along an II-II line in FIG. 1.

The oil pump 1 according to the present embodiment is installed in a car including an engine (not illustrated), pumps up oil out of an oil pan (not illustrated), and supplies oil to each unit of the engine such as a crankshaft (not illustrated). The oil pump 1 is an internal gear-type pump. The oil pump 1 includes a pump housing 2, an inner rotor 3, an outer rotor 4, and a shaft 5.

The pump housing 2 forms a contour of the oil pump 1. The pump housing 2 includes a body 21, a cover 22, a rotor housing space 23, a suction port 24, and a discharge port 25.

Hereinafter, a shaft direction of the shaft 5 is an A direction, and a direction of the A direction facing a cover 22 side from a body 21 side is an A1 direction, and an opposite direction is an A2 direction.

The body 21 and the cover 22 are coupled to each other, and form a contour of the pump housing 2. The body 21 and the cover 22 form the rotor housing space 23, the suction port 24, and the discharge port 25. The shaft 5 is inserted through the body 21 and the cover 22.

The rotor housing space 23 rotatably houses the inner rotor 3 and the outer rotor 4. The rotor housing space 23 is formed by blocking, by the cover 22, a recess in the A direction formed in the body 21. The rotor housing space 23 has the A direction as a thickness direction, and has a cylindrical shape corresponding to an outer shape of the outer rotor 4.

The suction port 24 is connected to the oil pan (not illustrated) located upstream of the suction port 24. The suction port 24 has, in a portion in which a pump room 34 described later expands, a suction opening 24*a* communicating with the pump room 34. The suction opening 24*a* functions as an inflow opening through which oil flows from the inside of the suction port 24 into the pump room 34.

The discharge port 25 is connected to each unit of an engine (not illustrated) located downstream of the discharge port 25. The discharge port 25 has, in a portion in which the pump room 34 is reduced, a discharge opening 25*a* communicating with the pump room 34. The discharge opening 25*a* functions as an outflow opening through which oil flows from the pump room 34 into the discharge port 25.

The inner rotor 3 and the outer rotor 4 are disposed in the pump housing 2 while the shaft 5 is inserted through the inner rotor 3 and the outer rotor 4. The inner rotor 3 is rotated by the shaft 5 in the pump housing 2. The outer rotor 4 is rotated by the shaft 5 via the inner rotor 3 in the pump housing 2. When the inner rotor 3 is rotated in an arrow R direction, the outer rotor 4 is rotated in the same direction. The inner rotor 3 (shaft 5) is configured in such a way as to rotate about a rotation center shaft line a eccentric with respect to a rotation center shaft line of the outer rotor 4.

As illustrated in FIG. 2, an external tooth 31 of the inner rotor 3 is disposed inside the outer rotor 4 in such a way as to engage with an internal tooth 41 of the outer rotor 4 from the inside. The number of the external teeth 31 of the inner rotor 3 is one less than the number of the internal teeth 41 of the outer rotor 4.

In rotation, the external tooth 31 of the inner rotor 3 and the internal tooth 41 of the outer rotor 4 mesh with each other on a side having a small distance between the inner rotor 3 and the outer rotor 4, and a gap (the pump room 34) is formed between the external tooth 31 and the internal tooth 41 without the external tooth 31 and the internal tooth 41 meshing with each other on a side having a great distance.

The inner rotor 3 and the outer rotor 4 create a pump function by causing the pump room 34 to rotate and move in the arrow R direction, and expanding and reducing the pump room 34. Therefore, oil flows from the suction port 24 into the pump room 34 due to expansion of a capacity of the pump room 34. Further, oil flows from the pump room 34 into the discharge port 25 due to a reduction of the capacity of the pump room 34.

The shaft 5 is rotatably attached to the pump housing 2 from the body 21 side. In the A direction, the shaft 5 is supported by the body 21 in the A2 direction with respect to a seal portion 61 and the cover 22 in the A1 direction with respect to the seal portion 61 and the inner rotor 3. Note that the shaft 5 may be rotatably attached to the pump housing 2 from the cover 22 side.

The shaft 5 generally has a cylindrical shape extending in the A direction. The shaft 5 includes a small diameter portion 51 in contact with the inner rotor 3 and the cover 22, and a large diameter portion 52 in contact with the body 21. A diameter of the small diameter portion 51 is smaller than a diameter of the large diameter portion 52. A surface that connects the small diameter portion 51 and the large diameter portion 52 is inclined with respect to the A direction. The surface that connects the small diameter portion 51 and the large diameter portion 52 and an end surface of the inner rotor 3 in the A2 direction are in non-contact. Note that the large diameter portion 52 may be disposed in a position in contact with the cover 22.

An end portion of the shaft 5 in the A2 direction receives rotation drive force (torque) from a crankshaft and the like via a belt (not illustrated), and rotates and drives, and thus the shaft 5 rotates and drives the inner rotor 3. Note that the shaft 5 is inserted through (fits in) the inner rotor 3 by press fitting, and integrally rotates with the inner rotor 3.

The body 21 includes the seal portion 61 that suppresses leakage of oil from the pump room 34 to the outside of the pump room 34. The seal portion 61 is in contact with a side surface of the inner rotor 3 extending in a diameter direction of the shaft 5. The seal portion 61 extends to a region in the diameter direction on an inner side than the large diameter portion in the diameter direction. The seal portion 61 and the shaft 5 are in non-contact.

A distance from an end surface of the suction opening 24*a* and the discharge opening 25*a* on a side closer to a shaft core of the shaft 5 to the shaft core is shorter than a distance from a tooth bottom 32 of the inner rotor 3 to the shaft core. In this way, in a region in which the suction opening 24*a* or the discharge opening 25*a* in a circumferential direction of the shaft 5 is connected to the pump room 34, the pump room 34 is not blocked by the seal portion 61.

As described above, at least the following effect can be acquired according to the present embodiment.

Since the small diameter portion 51 of the shaft 5 is inserted through the inner rotor 3, the inner rotor 3, the outer rotor 4, and the body 21 disposed around the small diameter portion 51 can be reduced in size and the entire oil pump 1 can be reduced in size. The seal portion 61 extends to the region in the diameter direction on the inner side than the large diameter portion 52, and thus a seal area of the pump housing 2 and the inner rotor 3 can increase, leakage of oil can be suppressed, and a decrease in discharge amount can be suppressed. Further, since the large diameter portion 52 of the shaft 5 is in contact with the pump housing 2, seizure on a sliding surface between the shaft 5 and the pump housing 2 can be suppressed.

Since the seal portion 61 and the shaft 5 are in non-contact, the shaft 5 can be supported by two points at some distance being the body 21 and the cover 22 instead of supporting the shaft 5 in the seal portion 61, the shaft 5 is inclined, and a decrease in discharge amount can be suppressed.

Since the surface that connects the small diameter portion 51 and the large diameter portion 52 is inclined with respect to the A direction, concentration of stress on a portion of the shaft 5 in which a size of a diameter is changed can be suppressed.

The pump room 34 is not blocked by the seal portion 61, and occurrence of trapped oil and a decrease in discharge amount can be suppressed.

An oil pump that solves the problem described above includes a pump housing including a rotor housing space inside, an inner rotor and an outer rotor being housed in the rotor housing space, a pump room being formed by the inner rotor and the outer rotor in the pump housing, and a shaft being inserted through the inner rotor. The pump housing includes a suction port that supplies oil to the pump room, a discharge port that discharges oil from the pump room, and a seal portion that suppresses leakage of oil from the pump room to the outside of the pump room. The shaft includes a small diameter portion and a large diameter portion having different diameters, and the small diameter portion is connected to the inner rotor, and the shaft and the inner rotor integrally rotate. The seal portion is in contact with a side surface of the inner rotor extending in a diameter direction of the shaft, and also extends to a region in the diameter direction on an inner side smaller than the large diameter portion in the diameter direction.

According to the configuration described above, since the small diameter portion of the shaft is inserted through the inner rotor, the inner rotor, the outer rotor, and the body being disposed around the small diameter portion can be reduced in size and the entire oil pump can be reduced in size. The seal portion extends to the region in the diameter direction on the inner side smaller than the large diameter portion, and thus a seal area of the pump housing and the inner rotor can increase, leakage of oil can be suppressed, and a decrease in discharge amount can be suppressed. Further, since the large diameter portion of the shaft is in contact with the pump housing, seizure on a sliding surface between the shaft and the pump housing can be suppressed.

The shaft may be in non-contact with the seal portion, and, in a shaft direction of the shaft, the shaft may be supported by a portion on one side in the shaft direction with respect to the seal portion and a portion on the other side in the shaft direction with respect to the seal portion and the inner rotor.

According to the configuration described above, the shaft can be supported by two points at some distance across the seal portion and the inner rotor instead of supporting the shaft by the seal portion, the shaft is inclined, and a decrease in discharge amount can be suppressed.

A surface that connects the small diameter portion and the large diameter portion may be inclined with respect to the shaft direction.

According to the configuration described above, concentration of stress, which is generated in the shaft when the shaft is rotated, on a portion of the shaft in which a size of a diameter is changed can be suppressed.

A distance from an end surface of the suction port and the discharge port on a side closer to a shaft core of the shaft to the shaft core may be shorter than a distance from a tooth bottom of the inner rotor to the shaft core.

According to the configuration described above, since the pump room is not blocked by the seal portion, occurrence of trapped oil and a decrease in discharge amount can be suppressed.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. An oil pump, comprising:

a pump housing including a rotor housing space inside;

an inner rotor and an outer rotor being housed in the rotor housing space;

a pump room being formed by the inner rotor and the outer rotor in the pump housing; and a shaft being inserted through the inner rotor, wherein the pump housing includes 1) a suction port that supplies oil to the pump room, 2) a discharge port that discharges oil from the pump room, and 3) a seal portion that suppresses leakage of oil from the pump room to outside of the pump room, the shaft includes a small diameter portion and a large diameter portion having different diameters, the small diameter portion is connected to the inner rotor, and the shaft and the inner rotor integrally rotate, the seal portion is in contact with a side surface of the inner rotor extending in a diameter direction of the shaft, and also extends to a region in the diameter direction on an inner side smaller than the large diameter portion in the diameter direction, the shaft is in non-contact with the seal portion, and, in a shaft direction of the shaft, the shaft is supported by a portion of the pump housing on one side in the shaft direction with respect to the seal portion and the inner rotor and a portion of the pump housing on another side in the shaft direction with respect to the seal portion and the inner rotor.

2. The oil pump according to claim 1, wherein a surface that connects the small diameter portion and the large diameter portion is inclined with respect to the shaft direction of the shaft.

3. The oil pump according to claim 2, wherein a distance from an inner surface of the suction port and the discharge port to a shaft core of the shaft is shorter than a distance from a tooth bottom of the inner rotor to the shaft core.

4. The oil pump according to claim 1, wherein a distance from an inner surface of the suction port and the discharge port to a shaft core of the shaft is shorter than a distance from a tooth bottom of the inner rotor to the shaft core.

* * * * *